US005803170A

United States Patent [19]

Garcia-Soule et al.

[11] Patent Number: 5,803,170

[45] Date of Patent: Sep. 8, 1998

[54] WELL LINE PROTECTIVE APPARATUS

[75] Inventors: Virgilio Garcia-Soule, Irving; Kenneth L. Schwendemann, Lewisville, both of Tex.

[73] Assignee: Halliburton Energy Services, Inc., Dallas, Tex.

[21] Appl. No.: 800,696

[22] Filed: Feb. 14, 1997

[51] Int. Cl.[6] ..... E21B 17/10; E21B 33/035

[52] U.S. Cl. ..... 166/242.3; 166/241.6; 166/363; 405/195.1

[58] Field of Search ..... 166/72, 97.5, 241.6, 166/242.1, 242.3, 313, 359, 360, 363, 241.7; 405/195.1; 138/115, 117

[56] References Cited

U.S. PATENT DOCUMENTS

| | | | |
|---|---|---|---|
| 3,844,345 | 10/1974 | Evans et al. | 166/242.3 X |
| 3,933,203 | 1/1976 | Evans | 166/241.6 |
| 4,042,023 | 8/1977 | Fox | 166/241.7 |
| 4,262,703 | 4/1981 | Moore et al. | 138/115 |
| 4,616,704 | 10/1986 | Johnston | 166/242.3 |
| 5,379,836 | 1/1995 | Jordan | 166/241.6 |

*Primary Examiner*—David J. Bagnell
*Attorney, Agent, or Firm*—William M. Imwalle; Paul I. Herman; J. Richard Konneker

[57] ABSTRACT

Installed in the tubing string portion of an offshore well rig are a vertically spaced pair of tubular well line protective devices. The upper device extends vertically through the openings in the rig floor and the rotary table thereon, and the lower device is positioned between a pair of sealing rams within an open upper end portion of the riser through which the tubing downwardly extends. Each protective device has a main body portion which is radially enlarged relative to the balance of the tubing string, and a removable side insert portion. Well lines, such as control, chemical and balancing lines, are extended through axial openings combinatively defined by each body and associated insert, with the insert shielding the lines from damage at the protective device location. The removable insert is illustrated in an all metal construction, used in the upper device, and an all elastomeric material construction or an elastomer-faced metal construction used in the lower device. The lower protective device is positioned between a pair of sealing rams. When the sealing rams close, the elastomeric portion of the insert portion of the lower device protects its associated well line portions from damage, and automatically creates seals around them, to block off the tubing/riser annulus and prevent leaking gas flow upwardly therethrough past the closed sealing rams. A bypass pipe structure disposed below the sealing rams diverts gas leakage outwardly past the rig when the rams are closed.

43 Claims, 3 Drawing Sheets

WELL LINE PROTECTIVE APPARATUS

BACKGROUND OF THE INVENTION

The present invention generally relates to well apparatus and, in a preferred embodiment thereof, more particularly relates to protective apparatus for use in shielding well lines, such as control, chemical and balance lines, against damage in offshore well applications.

Offshore oil and gas well apparatus, particularly where a floating rig is used, is susceptible to a variety of fabricational, testing and operational problems due to the often harsh marine environment in which it must reliably function. For example, in a conventional construction thereof, a tubular riser having an open top end is typically run from the rig downwardly to a large blowout preventer structure (BOP) on the sea floor.

Coaxially disposed within the riser, and creating an annular space therein, is a smaller diameter tubing string which extends downwardly through the sea floor into the fluid production zone and is used for testing or production as the case may be. At its upper end the tubing string extends upwardly through the open upper riser end and through an opening in the rig floor and the rotary table thereon.

In the blowout preventer structure on the sea floor are a variety of tubing and riser-mounted controllable structures, such as a retainer valve, a subsea testing tree (SSTT), a pipe sealing ram structure, and a blind shear ram structure. To operate these structures, and for a variety of other purposes, a series of well lines are run down the tubing/riser annulus and operatively connected to their associated tubing and riser mounted structures. Such well lines typically have elongated tubular or cylindrical configurations and may be, among other things, control lines, chemical lines, balancing lines, conduit-shrouded electrical lines, fiberoptic cables, or wire lines.

One of the problems that potentially may be encountered in this type of well construction is the leakage of gas from the production zone upwardly into the tubing/riser annulus. Such gas could be a poisonous one, most notably hydrogen sulfide, that passes upwardly through the annulus and out the open upper riser end to endanger the rig crew, or another type of gas such as carbon dioxide or hydrocarbon gas. Regardless of what type of gas finds its way into the tubing/riser annulus another problem is potentially created—namely, if the gas leakage flow rate is high enough it can cause a loss in buoyancy in the rig platform and cause it to sink.

The conventional approach to preventing gas leakage into the tubing/riser annulus has been to install on the riser a sealing ram structure disposed beneath the subsea tree within the blowout preventer structure on the sea floor. In this ram structure are a pair of opposing horizontally drivable ram members having semicircular sealing faces in a facing relationship with opposite side surface areas of the tubing structure positioned beneath the lower terminations of the well lines extending down the tubing/riser annulus.

In their normally open orientation, the ram members are held generally outwardly of the riser. However, when gas leakage into the annulus is detected, the ram members are driven to their closed positions in which they are in forcible sealing engagement with opposite external side surface portions of the tubing string and close off the annulus to prevent upward gas leakage flow therethrough past the closed ram members. Since if gas leakage into the annulus occurs it typically does so near the sea floor, below the sealing ram members, this shutoff approach generally functions well for its intended purpose.

But, if the gas leakage into the tubing/riser annulus occurs above this sealing ram structure (and above the emergency blind shear ram structure typically installed above it), for example via leakage through the tubing into the annulus, the typical action taken is to simply evacuate the rig since the leaking gas simply flows upwardly through the annulus and out the open upper end of the riser.

Another problem which can occur on a floating rig relates to potential damage to the aforementioned well lines where they pass with an upper end portion of the tubing through an opening on the rig floor and the rotary table thereon. Due to the often violent wind and wave-caused motion of the floating rig it is not uncommon for the surface of this opening to bang into the tubing portion extending upwardly therethrough and damage or completely disable the function of one or more well lines by crushing it against the outer side surface of this tubing section. This, of course, can hinder or terminate the particular well operation under way prior to this well line damage.

From the foregoing it can be seen that it would be highly desirable to solve these problems commonly associated with a variety of floating offshore oil and gas rigs. It is accordingly an object of the present invention to provide apparatus which eliminates or at least substantially reduces these two above-mentioned problems.

SUMMARY OF THE INVENTION

In carrying out principles of the present invention, in accordance with a preferred embodiment thereof, apparatus is provided for protecting a longitudinal portion of a well line member extending externally along and generally parallel to a well tubing string, representatively a tubing string used in an offshore floating type well rig, from impact damage.

From a broad perspective the apparatus comprises first and second cooperable members. The first member has a passage extending therethrough along an axis, and is coaxially connectable in the tubing string to define an axial section thereof. An axial portion of the first member has an exterior side surface positioned to extend laterally outwardly beyond the exterior side surface of the tubing string and has a recess configured to laterally receive the longitudinal well line member portion to be protected. The second member is removably receivable in the first member recess and is operative, when received therein, to laterally outwardly shield the longitudinal well line member portion within the recess.

Three embodiments of the second member are representatively provided—a first embodiment formed entirely from an essentially rigid material, a second embodiment formed entirely from a resilient material, and a third embodiment having a rigid main body portion and a resilient inner side section. Each second member embodiment is preferably configured to be axially inserted into the first member recess and to complementarily fill the entire recess area unoccupied by the longitudinal well line member portions therein.

In one representative application of the invention, the protective device, with the rigid first embodiment of the second member disposed in the side recess of the first member, is installed in the tubing string of a floating offshore rig and disposed within the vertical opening extending through the rig floor and the rotary table on the top side thereof to shield longitudinal well line portions passing through the opening from impact damage from its periphery during wind and wave—created movement thereof relative to the tubing string.

In another representative application of the invention, the protective device, with either the second or third resilient embodiment of the second member disposed in the first member side recess to protect the longitudinal well line portions extending therethrough, is disposed in an upper end portion of the riser structure of the rig between a pair of conventional sealing ram members carried by the riser. A gas bypass conduit communicates with the tubing/riser annulus below the sealing rams and extends horizontally away from the riser.

In the event that the leakage of gas into the tubing/riser annulus is detected, the ram members are driven horizontally through a closure stroke to forcibly engage and form an annular seal around the exterior side surface of the protective device, to thereby sealingly close off the annulus to upward gas flow past the closed ram members. Due to this annulus closure, the upwardly flowing gas is forced to flow outwardly through the bypass conduit for discharge a safe distance away from the rig.

The at least partially resilient second protective device member protects the longitudinal well line portions within the first member recess from damage due to the large transverse forces exerted on the protective device by the ram members. Additionally, the ram force causes the second member to create around the longitudinal well line portions a resilient seal that essentially prevents gas flow upwardly around the peripheries of such longitudinal well line portions.

DETAILED DESCRIPTION

Figure 1:
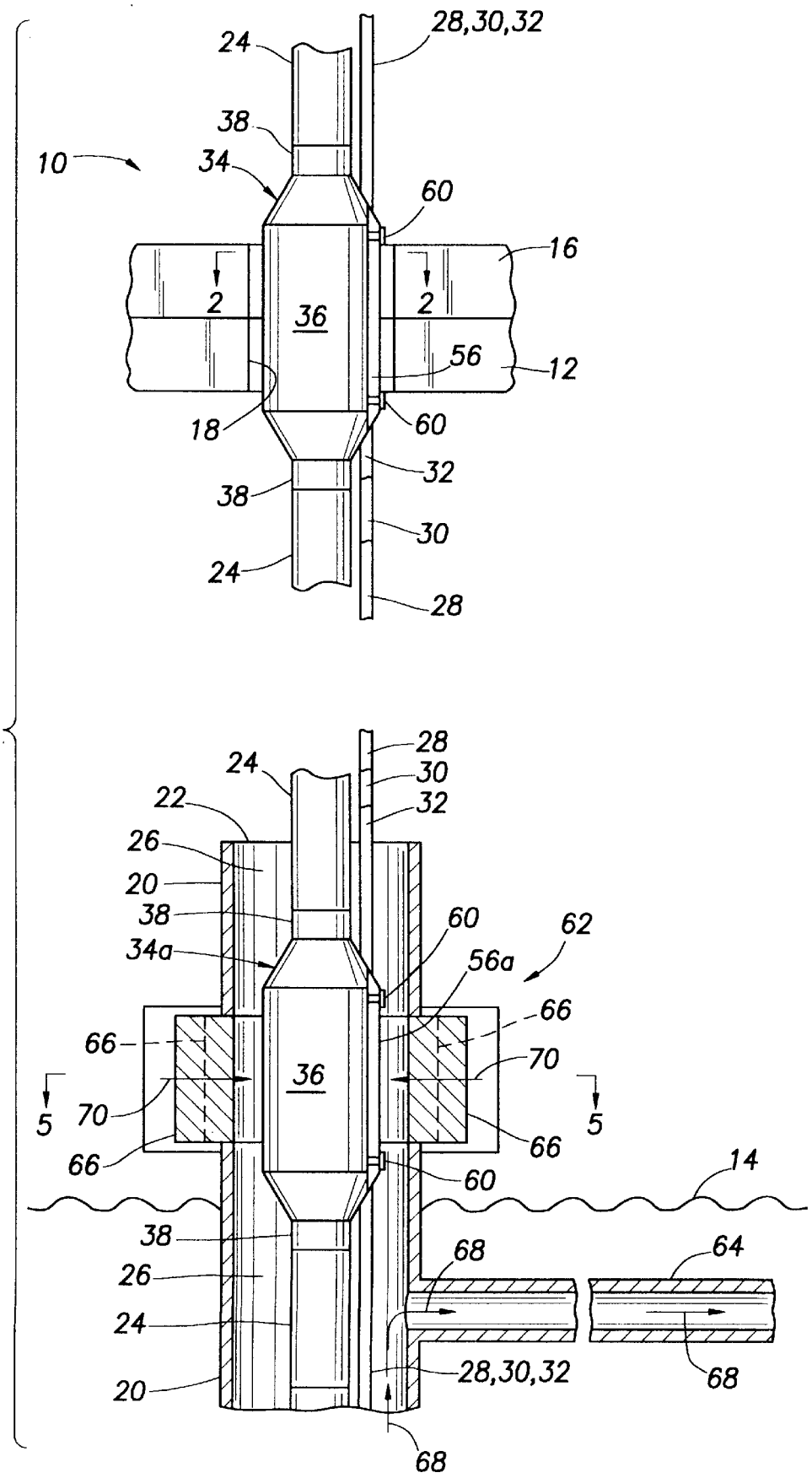
FIG. 1 is a highly schematic, partly elevational cross-sectional view through a vertically foreshortened longitudinal portion of tubing and related riser sections of a floating offshore well rig.

Schematically depicted in vertically foreshortened form in FIG. 1 are various portions of a floating type offshore well apparatus 10 including a rig floor structure 12 disposed above the water's surface 14 and having a rotary table 16 disposed thereon with an opening 18 extending vertically through the rig floor 12 and the rotary table 16. Positioned beneath the rig floor 12 is a vertically oriented hollow tubular riser 20 having an open top end 22 and extending downwardly to a conventional blowout preventer structure (not shown) on the sea floor. A tubing string 24 extends downwardly through the rig floor and rotary table opening 18 and the riser 20, with an annular space 26 being formed between the inner side surface of the riser 20 and the portion of the tubing string 24 extending through the riser 20.

Figure 3:
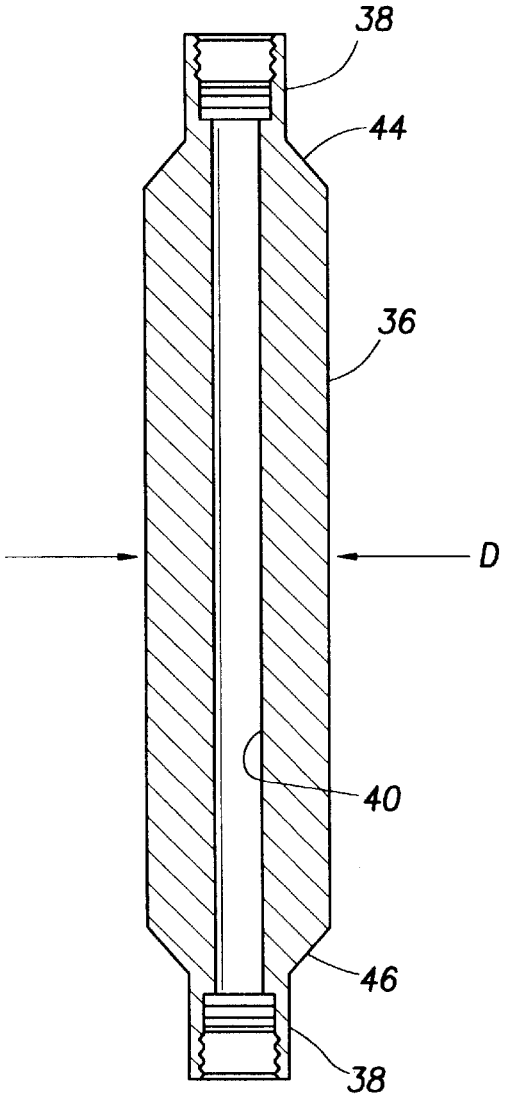
FIG. 3 is a reduced scale cross-sectional view through the main body portion of the protective device taken along line 3—3 of FIG. 2A.

Tubular well line members, representatively a control line 28, a chemical line 30 and a balancing line 32 (see FIGS. 3 and 5 also), vertically extend externally along and generally parallel to the tubing string 24, with the well line members being connected at their lower ends to various conventional equipment (not shown) adjacent the lower end of the riser 20. As used herein, the terms "well line", "well line member" and the like refer to any of the various elongated structures, such as control lines, chemical lines, balancing lines, wire lines, fiberoptic lines, conduit-shrouded electrical lines, etc. which, in addition to the tubing string, are run down the casing to facilitate the control, operation, testing, powering, servicing, inspection, etc. of the well.

A problem often encountered in floating offshore rigs such as the rig 10 is that due to often severe wind and wave conditions, the surface of the rig floor/rotary table opening 18 can be brought into forcible contact with the longitudinal portions of the well lines 28,30,32 passing through the opening 18, with the result that the well lines can be crushed against the tubing string or severed.

Figure 2:
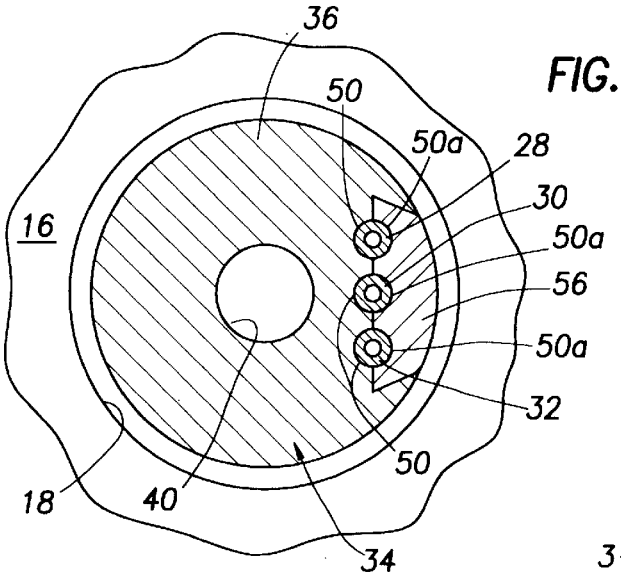
FIG. 2 is an enlarged scale cross-sectional view, taken along line 2—2 of FIG. 1, through a well line protective device embodying principles of the present invention.

Referring now to FIGS. 1–2A, 3 and 4, in the present invention this problem is uniquely solved using a specially designed well line protective device 34 which is installed in the tubing string 24 and forms an axial portion thereof, and is disposed within the rig floor/rotary table opening 18 as best illustrated in FIGS. 1 and 2. As will now be described, the device 34 laterally shields the longitudinal portions of well lines 28,30,32 disposed within the opening 18 from impact damage by the surface of the opening 18.

Figure 2A:
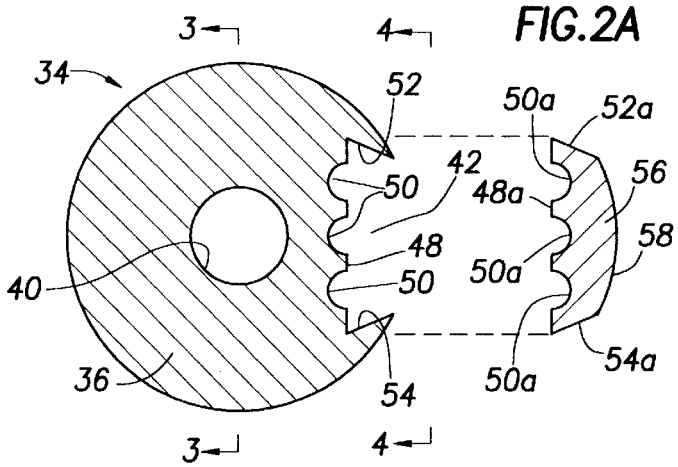
FIG. 2A is a view similar to that in FIG. 2, but with an insert portion of the protective device removed for illustrative purposes.
Figure 4:
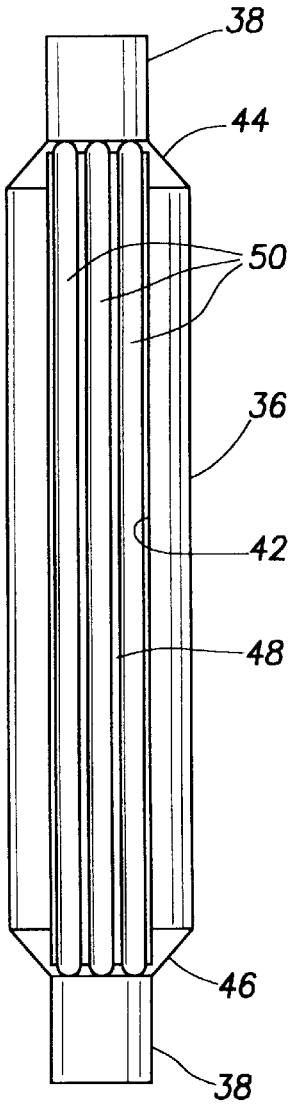
FIG. 4 is a side elevational view of the main body portion taken along line 4—4 of FIG. 2A.

Protective device 34 includes a generally tubular metal first member 36 having an outer diameter D (see FIG. 3) greater than that of the tubing string 24, a pair of opposite reduced diameter end portions 38 threadingly connectable to axially facing segments of the tubing string 24, and circularly cross-sectioned central axial passage 40 opening outwardly through the end portions 38. For purposes later described herein, and as best illustrated in FIGS. 2A and 4, the first member 36 has an axially elongated exterior side surface recess 42 which opens outwardly through top and bottom ends 44,46 of the radially thickened longitudinally intermediate portion of the first member 36. Recess 42 has a generally planar inner side surface 48 along the vertical length of which three spaced apart semicircularly cross-sectioned indentations 50 extend, each of the indentations 50 being sized to receive a semicircular lateral half of a longitudinal portion of one of the well lines 28,30,32. Adjacent the outer side of the recess 42 (see FIG. 2A) are opposing recess side surfaces 52,54 that slope toward one another in a radially outward direction.

The well line protective device 34 also includes a vertically elongated second metal member 56 (see FIGS. 1 and 2A) having a cross-section permitting it to be slidingly and complementarily inserted in an axial direction into the first member recess 42, a generally planar inner side surface 48*a* in which three spaced apart semicircularly cross-sectioned indentations 50*a* are formed, an arcuate outer side surface 58, and a pair of oppositely sloped side surfaces 52*a*,54*a* extending between the surfaces 48*a* and 58. Like the indentations 50, the indentations 50*a* are each configured to complementarily receive a semicircular lateral half of a longitudinal portion of one of the well lines 28,30,32. The side surfaces 52*a*,54*a* have slope angles substantially identical to those of the first member recess side surfaces 52 and 54.

With the second member 56 separated from its associated first member 36 as shown in FIG. 2A, lateral halves of longitudinal portions of the well lines 28,30,32 are placed in the first member recess side surface indentations 50 as shown in FIG. 2. Next, the complementarily cross-sectioned second member 56 is axially slid into place within the recess 42 in a manner such that, as shown in FIG. 2, the second member indentations 50*a* complementarily receive semicircular lateral halves of the longitudinal well line portions received in the recess 42.

The inserted second member 56 substantially fills the entire recess area unoccupied by portions of the well lines 28,30 and 32, and laterally outwardly shields such well line portions, with the first and second member side surfaces 48,48*a* being in a closely contiguous, substantially parallel relationship. By comparing FIGS. 2 and 2A it can be seen that, with the second member 56 operatively inserted into the first member recess 42, the cooperative engagement of the oppositely sloped side surface pairs 52,54 and 52*a*,54*a* of the first and second members 36,56 prevent the lateral dislodgement of the second member 56 from the first member recess 42. As schematically shown in FIG. 1, suitable fastening members 60 are appropriately extended through the second member 56 into the first member 36 to releasably prevent axial dislodgement of the second member 56 from the first member recess 42. As can further be seen in FIG. 2, the arcuate second member outer side surface 56 forms with the outer side surface of the first member 36 a substantially circular outer side surface portion of the protective device 34.

With the protective device 34 in place within the rig floor/rotary table opening 18 as shown in FIG. 1, the device 34 very strongly prevents the longitudinal portions of the well lines 28,30,32 within such opening from impact damage by its peripheral surface brought about by wind and wave-created movement of the opening relative to the tubing string 24. Lateral impact loads on the inserted second protective device member 56 are simply transferred to the first protective device member 36 without deforming or otherwise damaging the well line portions extending through the assembled protective device 34. Protective device 34 is easy and relatively inexpensive to manufacture, may be rapidly installed in the tubing string 24, and is quite simple to protectively install around the longitudinal well line portions to be shielded from damage.

Referring now to the bottom portion of FIG. 1, another potential problem presented in floating offshore well apparatus such as the rig 10 is the possibility of gas leakage into the tubing/riser annulus 26 above the conventional annulus shutoff equipment (such as sealing rams and shearing rams) typically installed in the blowout preventer structure on the sea floor (not shown). The resulting gas flow up the annulus 26 (arising, for example, from a leak in the tubing string 24 above the safety shutoff equipment at the sea floor) is potentially hazardous from two standpoints. First, if the gas is a poisonous one such as hydrogen sulfide, it can come up through the open riser end 22 and put the rig crew at risk from the gas itself. Second, regardless of the kind of gas entering and traveling up the annulus 26, if the gas flow rate is sufficiently high the rig platform can lose buoyancy and sink. The conventional approach to gas leakage into the annulus 26 above the safety annulus shutoff equipment at the sea floor has been simply to evacuate the rig.

As schematically depicted in a bottom portion of FIG. 1, the present invention uniquely addresses and substantially solves this potential gas leakage problem by utilizing a well line protective device 34*a* disposed within an upper end portion of the riser 20 and positioned within a conventional sealing ram structure 62 supported on the riser 20 above a gas bypass conduit structure 64 communicated with the tubing/riser annulus 26 at a point below the sealing ram structure 62.

Figure 5:
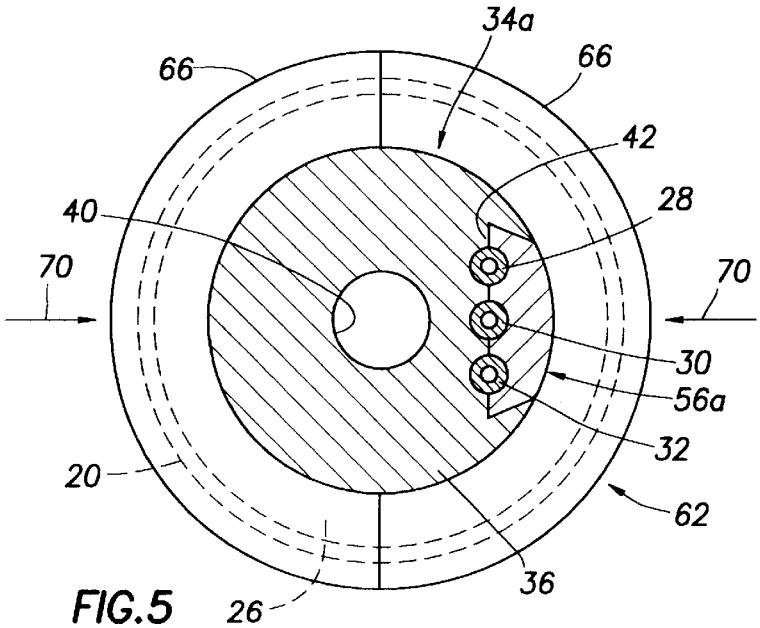
FIG. 5 is an enlarged scale cross-sectional view, taken along line 5—5 of FIG. 1, through a sealing ram structure incorporating therein an alternate embodiment of the well line protective device.

The well line protective device 34*a* is installed in the tubing string 24 and is identical to the previously described protective device 34 with the exception that it utilizes a different second member 56*a* (see FIG. 5). Second member 56*a* has a configuration identical to that of the previously described second member 56 but is formed entirely from a resilient material such as a suitable elastomeric material. Like its counterpart 56 the resilient second member 56*a* is axially inserted into the first member recess 42, to laterally outwardly shield the longitudinal portions of the well line members 28,30,32 passing through the protective device 34*a*, and is axially retained in the recess 42 by fastening members 60.

Ram structure 62, as mentioned above, is of a generally conventional construction and includes an opposed pair of semicircular ram members 66 which, in their solid line open position, face opposite exterior side portions of the protective device 34*a* and are outwardly withdrawn from the annulus 26. When a leakage of gas 68 upwardly through the annulus 26 is appropriately sensed, the ram members 66 are horizontally driven through a closure stroke, as indicated by the arrows 70 in FIGS. 1 and 5, to their closed position indicated in FIG. 5 and in phantom in FIG. 1. In such closed position the ram members 66 sealingly engage the exterior side surface of the protective device 34*a* and block off upward flow of the leaking gas 68 through the annulus 26 past the closed ram members.

The resilient second member 56*a* serves to protect the longitudinal portions of the well lines 28,30,32 extending through the protective device from the very large horizontal force of the ram members 66. Additionally, the ram forces serve to horizontally compress the second member 56*a* against the longitudinal portions of the well lines 28,30,32 to thereby form a seal around them and prevent upward gas flow around their peripheries.

With the annulus 26 sealingly blocked off in this manner, the gas 68 is forced to flow outwardly through the bypass conduit 64, as shown in FIG. 1 (instead of simply exiting the annulus 26 through the open top end 22 of the riser 20), for diversion to a location disposed a safe distance away from the rig.

Figure 6:
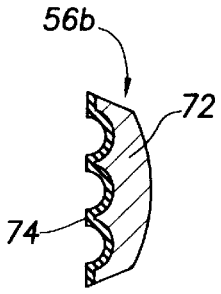
FIG. 6 is a cross-sectional view of a modified version of the insert portion of the FIG. 5 well line protective device.

In place of the all-elastomer second member 56*a*, a modified version 56*b* thereof (see FIG. 6) may be utilized. The modified second member 56*b* has a metal main body portion 72 with an elastomeric inner side portion 74 which, with the ram members 66 in their closed positions, is deformed and seals against the longitudinal portions of the well lines 28,30,32 passing through and laterally shielded within the first member passage 42.

While the protective devices 36,36*a* have been representatively illustrated as being used to laterally shield longitudinal portions of three well line members, it will be readily appreciated by those of skill in this particular art that it could be used to so shield a greater or lesser number of well line members if desired. For example, a larger or smaller number of well lines (depending on their lateral dimensions) could be shielded within the indicated first member recesses 42 if desired. Moreover, one or more additional exterior side surface recesses could be formed in the first member and used in conjunction with additional second members to shield a greater number of well line members. Finally, while the protective devices 36,36*a* have been representatively illustrated as being incorporated in an offshore well system, it will be readily appreciated by those of skill in this particular art that they could used in other types of well applications as well.

The foregoing detailed description is to be clearly understood as being given by way of illustration and example only, the spirit and scope of the present invention being limited solely by the appended claims.

What is claimed is:

1. Apparatus for protecting a longitudinal portion of a well line member extending externally along and generally parallel to a well tubing string, said apparatus comprising:

a first member having a passage extending therethrough along an axis, the first member being coaxially connectable in the tubing string and having an axial portion with an exterior side surface positioned to extend laterally outwardly beyond the exterior side surface of the tubing string, the exterior side surface of the first member having a recess configured to laterally receive the longitudinal well line member portion; and a second member removably receivable in the recess and operative, when received therein, to laterally outwardly shield the longitudinal well line member portion within the recess, the recess having a laterally inner side surface with an indentation formed therein and configured to complementarily receive a first lateral portion of the longitudinal well line member portion, and the second member having a laterally inner side surface positionable in a parallel, closely contiguous relationship with the laterally inner side surface of he recess and having an indentation configured to complementarily receive a second lateral portion of the longitudinal well line member portion.

2. The apparatus of claim 1 wherein the first member has a generally tubular configuration with a longitudinal portion, in which the recess is formed, having an external diameter larger than that of the tubing string.

3. The apparatus of claim 2 wherein the first member has reduced diameter opposite end portions.

4. The apparatus of claim 1 wherein:

the well line member, along its length, has a generally circular outer side, and the indentations in the inner side surfaces of the recess and the second member are generally semicircular.

5. The apparatus of claim 4 wherein each of the laterally inner side surfaces of the recess and the second member has an additional generally semicircular indentation positioned and configured to complementarily receive opposite semicircular lateral portions of a longitudinal portion of an additional well line member.

6. The apparatus of claim 1 wherein the laterally inner side surfaces of the recess and the second member are each substantially planar.

7. The apparatus of claim 1 wherein the second member is formed entirely from an essentially rigid material.

8. The apparatus of claim 1 further comprising a holding structure for releasably holding the second member in the recess.

9. The apparatus of claim 8 wherein:

the second member is axially slidably insertable into the recess, and the holding structure includes cooperatively engageable surface portions on the recess and the second member configured to preclude lateral removal of the second member from the recess.

10. The apparatus of claim 9 wherein the holding structure further includes at least one fastening member extendable through the first and second members and operative to preclude axial removal of the second member from the recess.

11. Apparatus for protecting a longitudinal portion of a well line member extending externally along and generally parallel to a well tubing string, said apparatus comprising:

a first member having a passage extending therethrough along an axis, the first member being coaxially connectable in the tubing string and having an axial portion with an exterior side surface positioned to extend laterally outwardly beyond the exterior side surface of the tubing string, the exterior side surface of the first member having a recess configured to laterally receive the longitudinal well line member portion; and a second member removably receivable in the recess and operative, when received therein, to laterally outwardly shield the longitudinal well line member portion within the recess, the second member being formed entirely from a resilient material.

12. Apparatus for protecting a longitudinal portion of a well line member extending externally along and generally parallel to a well tubing string, said apparatus comprising:

a first member having a passage extending therethrough along an axis, the first member being coaxially connectable in the tubing string and having an axial portion with an exterior side surface positioned to extend laterally outwardly beyond the exterior side surface of the tubing string, the exterior side surface of the first member having a recess configured to laterally receive the longitudinal well line member portion; and a second member removably receivable in the recess and operative, when received therein, to laterally outwardly shield the longitudinal well line member portion within the recess, the second member having a main body portion formed from an essentially rigid material, and an inner side portion formed from a resilient material.

13. Apparatus for protecting a longitudinal portion of a well line member extending externally along and generally parallel to a well tubing string, said apparatus comprising:

a first member having a passage extending therethrough along an axis, the first member being coaxially connectable in the tubing string and having an axial portion with an exterior side surface positioned to extend laterally outwardly beyond the exterior side surface of the tubing string, the exterior side surface of the first member having a recess configured to laterally receive the longitudinal well line member portion; and a second member removably receivable in the recess and operative, when received therein, to laterally outwardly shield the longitudinal well line member portion within the recess, the second member, when operatively disposed in the recess, being configured to essentially fill the recess area unoccupied by the longitudinal portion of the well line member.

14. The apparatus of claim 13 wherein the second member has an arcuate outer side surface which, with the second member operatively disposed in the recess, forms with the outer side surface of the longitudinal portion of the first member a generally circular outer surface area circumscribing the axis of the first member.

15. Well apparatus comprising:

a tubing string;

a well line member extending externally along and generally parallel to the tubing string; and a well line member protective device including:

a first member having a passage extending therethrough along an axis, the first member being coaxially connected in and forming an axial portion of the tubing string, the first member having an axial portion with an exterior side surface positioned laterally outwardly of adjacent outer side surface portions of the tubing string, the exterior side surface of the first member having a recess receiving a longitudinal portion of the well line member, and a second member removably received in the recess and laterally outwardly shielding the longitudinal well line member portion, the recess having a laterally inner side surface with an indentation formed therein and complementarily receiving a first lateral portion of the longitudinal well line member portion, and the second member having a laterally inner side surface positioned in a parallel, closely contiguous relationship with the laterally inner side surface of the recess and having an indentation complementarily receiving a second lateral portion of the longitudinal well line member portion.

16. The well apparatus of claim 15 wherein the first member has a generally tubular configuration with a longitudinal portion, in which the recess is formed, having an external diameter larger than that of the tubing string portions to which the protective device is connected.

17. The well apparatus of claim 16 wherein the first member has reduced diameter opposite end portions.

18. The well apparatus of claim 15 wherein:

the well line member, along its length has a generally circular outer side, and the indentations in the inner side surfaces of the recess and the second member are generally semicircular.

19. The well apparatus of claim 18 wherein:

the well apparatus further comprises an additional well line member, and each of the laterally inner side surfaces of the recess and the second member has an additional generally semicircular indentation complementarily receiving opposite semicircular lateral portions of a longitudinal portion of the additional well line member.

20. The well apparatus of claim 15 wherein the laterally inner side surfaces of the recess and the second member are each substantially planar.

21. The well apparatus of claim 14 wherein the second member is formed entirely from an essentially rigid material.

22. The well apparatus of claim 15 further comprising a holding structure for releasably holding the second member in the recess.

23. The well apparatus of claim 22 wherein:

the second member is axially slidably received in the recess, and the holding structure includes cooperatively engaged surface portions on the recess and the second member precluding lateral removal of the second member from the recess.

24. The well apparatus of claim 23 wherein the holding structure further includes at least one fastening member extending through the first and second members and precluding axial removal of the second member from the recess.

25. The well apparatus of claim 15 wherein the second member essentially fills the recess area unoccupied by the longitudinal portion of the well line member.

26. The well apparatus of claim 25 wherein the second member has an arcuate outer side surface which forms with the outer side surface of the longitudinal portion of the first member a generally circular outer surface area of the device.

27. The well apparatus of claim 15 wherein:

the well apparatus further comprises a generally horizontal floating offshore well rig portion with an opening extending vertically therethrough and receiving the protective device, and the protective device functions to laterally shield the longitudinal well line member portion from impact damage by the peripheral surface of the opening.

28. The well apparatus of claim 27 wherein:

the second member is formed from an essentially rigid material and substantially fills the portion of the recess unoccupied by the longitudinal well line member portion.

29. Well apparatus comprising:

a tubing string;

a well line member extending externally along and generally parallel to the tubing string; and a well line member protective device including:

a first member having a passage extending therethrough along an axis, the first member being coaxially connected in and forming an axial portion of the tubing string, the first member having an axial portion with an exterior side surface positioned laterally outwardly of adjacent outer side surface portions of the tubing string, the exterior side surface of the first member having a recess receiving a longitudinal portion of the well line member, and a second member removably received in the recess and laterally outwardly shielding the longitudinal well line member portion, the second member being formed entirely from a resilient material.

30. Well apparatus comprising:

a tubing string;

a well line member extending externally along and generally parallel to the tubing string; and a well line member protective device including:

a first member having a passage extending therethrough along an axis, the first member being coaxially connected in and forming an axial portion of the tubing string, the first member having an axial portion with an exterior side surface positioned laterally outwardly of adjacent outer side surface portions of the tubing string, the exterior side surface of the first member having a recess receiving a longitudinal portion of the well line member, and, a second member removably received in the recess and laterally outwardly shielding the longitudinal well line member portion, the second member having a main body portion formed from an essentially rigid material, and an inner side portion formed from a resilient material.

31. Well apparatus comprising:

a tubing string;

a well line member extending externally along and generally parallel to the tubing string;

a well line member protective device including:

a first member having a passage extending therethrough along an axis, the first member being coaxially connected in and forming an axial portion of the tubing string, the first member having an axial portion with an exterior side surface positioned laterally outwardly of adjacent outer side surface portions of the tubing string, the exterior side surface of the first member having a recess receiving a longitudinal portion of the well line member, and a second member removably received in the recess and laterally outwardly shielding the longitudinal well line member portion:

a vertical tubular subsea riser structure, the tubing string and the well line member extending downwardly through the riser structure, the tubing string forming in the riser structure an annulus circumscribing the tubing string, the protective device being disposed within the riser structure; and a sealing ram structure carried on the riser structure and operative to be forcibly driven through a closure stroke into sealing engagement with opposite exterior side surface portions of the protective device and block the annulus in a manner preventing appreciable fluid flow upwardly therethrough past the closed ram structure, the second member, in response to closure of the ram structure, operating to create a substantially fluid tight seal around the longitudinal well line member portion.

32. The well apparatus of claim 31 wherein the second member is formed entirely from a resilient material.

33. The well apparatus of claim 31 wherein the second member has a main body portion formed from an essentially rigid material, and an inner side portion proximate the longitudinal well line member portion and formed from a resilient material.

34. The well apparatus of claim 31 further comprising a conduit structure communicating with the annulus below the sealing ram structure and defining a fluid bypass passage extending outwardly from the riser structure.

35. The well apparatus of claim 34 wherein;

the riser structure has an open upper end, and the protective device is positioned below the open upper end.

36. Apparatus for protecting a longitudinal portion of a well line member extending externally along and generally parallel to a well tubing string, said apparatus comprising:

a first member connectable to the tubing string and having an exterior side surface with a recess disposed therein, the recess having a first portion through which the well line portion may longitudinally pass, and a second portion unoccupied by the well line portion received in the recess; and a second member removably insertable into the recess in a direction parallel to the length of the well line member portion received therein and being configured to cooperate with the first member to form therebetween a passage having a side surface that contiguously circumscribes the well line portion.

37. The apparatus of claim 36 further comprising a holding structure for releasably holding the second member within the recess.

38. The apparatus of claim 37 wherein the holding structure includes cooperating portions on the first and second members which are operative to prevent the inserted second member from being removed from the recess in a direction transverse to the length of the received well line member portion.

39. The apparatus of claim 38 wherein:

the first member has a generally tubular configuration and is coaxially connectable in the well tubing string, and the cooperating portions on the first and second members include spaced apart opposing recess side surfaces that slope toward one another in a radially outward direction.

40. The apparatus of claim 38 wherein the holding structure includes a fastening member extendable through the first and second members and operative to preclude removal of the second member from the recess in a direction parallel to the length of the well line portion.

41. The apparatus of claim 36 wherein the second member is formed entirely from an essentially rigid material.

42. The apparatus of claim 36 wherein the second member is formed entirely from a resilient material.

43. The apparatus of claim 36 wherein the second member has a main body portion formed from an essentially rigid material, and an inner side portion formed from a resilient material.

* * * * *